US005614933A

United States Patent [19]

Hindman et al.

[11] Patent Number: 5,614,933

[45] Date of Patent: Mar. 25, 1997

[54] METHOD AND APPARATUS FOR CONTROLLING PHASE-CHANGE INK-JET PRINT QUALITY FACTORS

[75] Inventors: Larry E. Hindman, Woodburn; Randy C. Karambelas, Milwaukie; Barry D. Reeves; James D. Rise, both of Lake Oswego, all of Oreg.

[73] Assignee: Tektronix, Inc., Wilsonville, Oreg.

[21] Appl. No.: 255,585

[22] Filed: Jun. 8, 1994

[51] Int. Cl.[6] ..... B41J 27/16

[52] U.S. Cl. ..... 347/103; 347/88

[58] Field of Search ..... 347/103, 88, 99, 347/105; 355/274, 256

[56] References Cited

U.S. PATENT DOCUMENTS

| | | | |
|---|---|---|---|
| 4,168,119 | 9/1979 | Nishimura | 355/256 |
| 4,538,156 | 8/1985 | Durkee et al. | 347/103 X |
| 4,673,303 | 6/1987 | Sansone et al. | 347/103 X |
| 4,731,647 | 3/1988 | Kohsahi | 358/75 |
| 4,741,930 | 5/1988 | Howard | 347/105 |
| 4,801,473 | 1/1989 | Creagh | 347/105 X |
| 4,833,530 | 5/1989 | Kohsahi | 358/75 |
| 4,889,560 | 12/1989 | Jaeger et al. | 106/27 |
| 4,889,761 | 12/1989 | Titterington et al. | 428/195 |
| 5,043,741 | 8/1991 | Spehrley | 347/88 |
| 5,092,235 | 3/1992 | Rise | 100/168 |
| 5,099,256 | 3/1992 | Anderson | 347/103 |
| 5,372,852 | 12/1984 | Titterington | 347/103 X |
| 5,389,958 | 2/1995 | Bui | 347/103 |

FOREIGN PATENT DOCUMENTS

| | | | |
|---|---|---|---|
| 0583168 | 8/1993 | European Pat. Off. | B41M 5/38 |
| 401146750 | 6/1989 | Japan | B41J 3/04 |
| 405147209 | 6/1993 | Japan | B41J 2/015 |
| 9401283 | 1/1994 | WIPO | B41J 2/01 |

*Primary Examiner*—Joseph W. Hartary
*Attorney, Agent, or Firm*—Ralph D'Alessandro

[57] ABSTRACT

A phase change ink transfer printing apparatus (10) applies a liquid intermediate transfer surface (12) to a heated drum (14, 28). Because the intermediate transfer surface is a thin liquid layer, molten ink drops (122) striking it flatten and spread out (110, 112, 114, 130) prior to cooling and solidifying as an ink image (26, 130) at the drum temperature. After the ink image is deposited, a print medium (21, 132), such as a transparency film, is fed into a nip (22) formed between the heated drum and an elastomeric transfer roller (23). As the drum turns, the print medium is pulled through the nip to transfer the ink image to the print medium. When in the nip, heat from the drum and print medium combine to heat the ink in accordance with a process window (90), making the ink sufficiently soft and tacky to adhere to the print medium but not to the drum. The ink drops comprising the ink image have a desired diameter to height ratio of from about 1.5:1 to greater than about 4:1 using the apparatus and method of printing disclosed. When the print medium leaves the nip, stripper fingers (24) peel it from the drum and direct it into a media exit path. No image post processing or fusing is necessary to achieve a high-quality print suitable for transparency projection.

14 Claims, 10 Drawing Sheets

METHOD AND APPARATUS FOR CONTROLLING PHASE-CHANGE INK-JET PRINT QUALITY FACTORS

TECHNICAL FIELD

This invention relates generally to phase-change ink-jet printing and more particularly to a printing system and process that achieves optimal image quality without requiring image post processing or fusing.

BACKGROUND OF THE INVENTION

Ink-jet printing systems have been employed utilizing intermediate transfer surfaces, such as that described in U.S. Pat. No. 4,538,156 issued Aug. 27, 1985 for an INK JET PRINTER in which an intermediate transfer drum is employed with a printhead. A final receiving surface of paper is brought into contact with the intermediate transfer drum after the image has been placed thereon by the nozzles in the printhead. The image is then transferred to the final receiving surface. Because the nozzles eject an aqueous ink, the ink drops flatten and spread out when received by the intermediate transfer drum. Moreover, with aqueous printing the ink drops undergo additional spreading during transfer to the final receiving surface making it difficult to control image quality.

U.S. Pat. No. 5,099,256 issued Mar. 24, 1992 for an INK JET PRINTER WITH INTERMEDIATE DRUM describes an intermediate drum with a surface that receives ink droplets from a printhead. The intermediate drum surface is thermally conductive and formed from a suitable film-forming silicone polymer allegedly having a high surface energy and high degree of surface roughness to prevent movement of the ink droplets after receipt from the printhead nozzles. Other imaging patents, such as U.S. Pat. Nos. 4,731,647 issued Mar. 15, 1988 and 4,833,530 issued May 23, 1989, describe a solvent that is deposited on colorant to dissolve the colorant and form a transferable drop to a recording medium. The colorants are deposited directly onto paper or plastic colorant transfer sheets. The transferable drops are then contact transferred to the final receiving surface medium, such as paper. Such printing systems are unduly complex.

U.S. Pat. No. 4,673,303 issued Jun. 16, 1987 for OFFSET INK JET POSTAGE PRINTING describes an offset ink-jet postage printing method and apparatus in which an inking roll applies ink to the first region of a dye plate. A lubricating hydrophilic oil is applied to the exterior surface of the printing drum or roll to facilitate the accurate transfer of the images from the drum or roll to the receiving surface. Image quality is difficult to control because aqueous ink is employed.

Moreover, all of the above-described processes do not achieve a complete image transfer from the intermediate transfer surface and, therefore, require a separate cleaning step to remove any residual ink from the intermediate receiving surface. The inclusion of a cleaning apparatus can be both costly and time consuming in color printing equipment. Prior intermediate transfer surfaces also have not been renewable.

The prior processes are also limited in the degree of image quality that can be achieved on different types of final receiving surfaces or print media. Because the inks are fluids, they are subject to uncontrolled bleeding on porous media, such as paper, and uncontrolled spreading on transparency films or glossy coated papers.

The above-described problems are addressed by processes and apparatus described in co-pending U.S. patent application Ser. No. 08/223,265 filed Apr. 4, 1994 now U.S. Pat. No. 5,502,476 for METHOD AND APPARATUS FOR CONTROLLING PHASE-CHANGE INK TEMPERATURE DURING A TRANSFER PRINTING PROCESS, which is assigned to the assignee of this application. A transfer printer employing phase-change ink is described in which a liquid intermediate transfer surface is provided that receives a phase-change ink image on a drum. The image is then transferred from the drum with at least a portion of the intermediate transfer surface to a final receiving medium, such as paper or a transparency film.

In particular, the phase-change ink transfer printing process begins by first applying a thin liquid intermediate transfer surface to the drum. Then an ink-jet printhead deposits molten ink onto the drum where it solidifies and cools to about drum temperature. After depositing the image, the print medium is heated by feeding it through a preheater and into a nip formed between the drum and an elastomeric transfer roller which can also be heated. As the drum turns, the heated print medium is pulled through the nip and is pressed against the deposited image, thereby transferring the ink to the heated print medium. When in the nip, heat from the preheated print medium heats the ink, making the ink sufficiently soft and tacky to adhere to the print medium. When the print medium leaves the nip, stripper fingers peel it from the drum and direct it into a media exit path.

In practice, it has been determined that a transfer printing process should meet at least the following criteria to produce acceptable prints. To optimize image resolution, the transferred ink drops should spread out to cover a predetermined area, but not so much that image resolution is lost. The ink drops should not melt during the transfer process. To optimize printed image durability, the ink drops should be pressed into the paper with sufficient pressure to prevent their inadvertent removal by abrasion. Finally, image transfer conditions should be such that nearly all of the ink drops are transferred from the drum to the print medium.

Unfortunately, the proper set of image transfer conditions is dependent on a complexly interrelated set of pressure, temperature, time, ink parameters, and print medium characteristics that have not been well understood, thereby preventing phase-change transfer printing from meeting its full potential for rapidly producing high-quality prints.

Phase-change ink-jet printing on transparency film emphasizes another problem: non-rectilinear light transmission. When individual ink drops are jetted onto the transparency film they solidify into a lens-like shape having a diameter to height ratio of about 4:1 that disperses transmitted light rays, resulting in a very dim projected image. This problem is generally solved by post processing the image with some combination of temperature and pressure that flattens the ink drops. U.S. Pat. No. 4,889,761 issued Dec. 26, 1989 for SUBSTRATES HAVING A LIGHT-TRANSMISSIVE PHASE-CHANGE INK PRINTED THEREON AND METHODS FOR PRODUCING SAME, which is assigned to the assignee of this application, describes passing a print medium through a nip formed between two rollers at a nip pressure of about 3,500 pound/inch$^2$ ("psi") to flatten the ink drops and fuse them into the pores and fibers of the print medium. Controlled pressure in the nip flattens the ink drops into a pancake shape to provide a more light-transmissive shape and to achieve a degree of drop spreading appropriate for the printer resolution. The roller surfaces may be textured to emboss a desired reflective pattern into the fused image. Unfortunately, such rollers are expensive, bulky, provide nonuniform fusing pressure, and can cause print medium deformations.

What is needed, therefore, is a phase-change printing process and apparatus that controls the ink drop flatness and spreading to produce consistently high-quality prints on a wide range of print media including transparency film, ideally without requiring print media post processing or fusing.

SUMMARY OF THE INVENTION

An object of this invention is, therefore, to provide a phase-change ink-jet printing apparatus and a method that produces prints suitable for transparency film projection without requiring image post processing or fusing.

Another object of this invention is to provide a phase-change ink-jet printing apparatus and a method that produces high-quality prints characterized by uniform ink drop spread and solid area fill across an entire print medium area.

A further object of this invention is to provide an apparatus and a method for producing controllably flattened ink drops in transfer printing and direct printing phase-change ink-jet printers.

Accordingly, this invention provides a phase-change ink transfer printing apparatus and process that starts by applying a thin layer of a liquid intermediate transfer surface to a heated receiving surface, such as a drum. Because the intermediate transfer surface is a thin liquid layer, the molten ink drops striking it flatten and spread out prior to cooling and solidifying at the room or ambient temperature or the drum temperature if different. After the image is deposited, a print medium is heated by a preheater to a predetermined temperature and fed into a nip formed between the heated drum and an elastomeric transfer roller that is biased toward the drum to form a nip pressure that is about twice the yield strength of the ink in the deposited image. As the drum turns, the heated print medium is pulled through the nip at a predetermined rate to transfer and fuse the ink image to the print medium. When in the nip, heat from the drum and print medium combine to heat the ink in accordance with a process window, making the ink sufficiently soft and tacky to adhere to the print medium but not to the drum. When the print medium leaves the nip, stripper fingers peel it from the drum and direct it into a media exit path. No image post processing or fusing is necessary to achieve high-quality print.

Additional objects and advantages of this invention will be apparent from the following detailed description of preferred embodiments thereof that proceed with reference to the accompanying drawings.

DETAILED DESCRIPTION OF PREFERRED EMBODIMENTS

Figure 1:
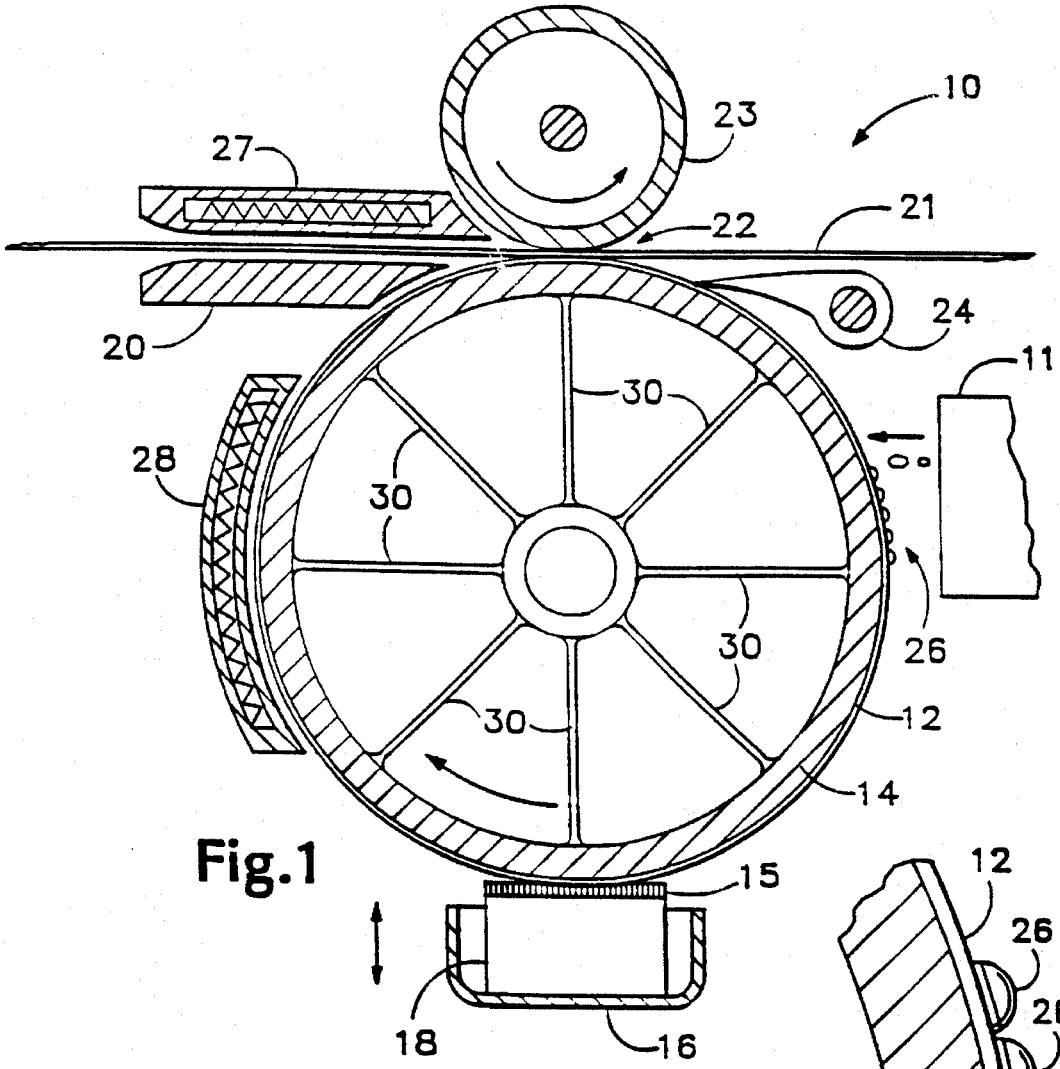
FIG. 1 is a pictorial schematic diagram showing a transfer printing apparatus having a supporting surface adjacent to a liquid layer applicator and a printhead that applies the image to be transferred to the liquid layer.

FIG. 1 shows an imaging apparatus 10 utilized in this process to transfer an inked image from an intermediate transfer surface to a final receiving substrate. A printhead 11 is supported by an appropriate housing and support elements (not shown) for either stationary or moving utilization to place an ink in the liquid or molten state on a supporting intermediate transfer surface 12 that is applied to a supporting surface 14. Intermediate transfer surface 12 is a liquid layer that is applied to supporting surface 14, such as a drum, web, platen, or other suitable design, by contact with an applicator, such as a metering blade, roller, web, or wicking pad 15 contained within an applicator or blade metering assembly 16.

Supporting surface 14 (hereafter "drum 14") may be formed from or coated with any appropriate material, such as metals including, but not limited to, aluminum or nickel, elastomers including, but not limited to, fluoroelastomers, perfluoroelastomers, silicone rubber, and polybutadiene, plastics including, but not limited to, polyphenylene sulfide loaded with polytetrafluorethylene, thermoplastics such as acetals, polyethylene, nylon, and FEP, thermosets and ceramics. The preferred material is anodized aluminum.

Applicator assembly 16 optionally contains a reservoir 18 for the liquid and most preferably contains a web and web advancing mechanism (both not shown) to periodically present fresh web for contact with drum 14.

Wicking pad 15 or the web are synthetic textiles. Preferably wicking pad 15 is needled felt and the web is any appropriate nonwoven synthetic textile with a relatively smooth surface. An alternative configuration employs a smooth wicking pad 15 mounted atop a porous supporting material, such as a polyester felt. Both materials are available from BMP Corporation as BMP products NR 90 and PE 1100-UL, respectively.

Applicator apparatus 16 is mounted for retractable movement upward into contact with the surface of drum 14 and downwardly out of contact with the surface of the drum 14 and its intermediate transfer surface 12 by means of an appropriate mechanism, such as a cam, an air cylinder, or an electrically actuated solenoid.

A final substrate guide 20 passes a final receiving substrate 21, such as paper, from a positive feed device (not shown) and guides it through a nip 22 formed between the opposing arcuate surfaces of a roller 23 and intermediate transfer surface 12 supported by drum 14. Stripper fingers 24 (only one of which is shown) may be pivotally mounted to imaging apparatus 10 to assist in removing final receiving substrate 21 from intermediate transfer surface 12. Roller 23 has a metallic core, preferably steel, with an elastomeric covering having a Shore D hardness or durometer of 40 to 45. Suitable elastomeric covering materials include silicones, urethanes, nitriles, EPDM, and other appropriately resilient materials. The elastomeric covering on roller 23 engages final receiving substrate 21 on a reverse side to which an ink image 26 is transferred from intermediate transfer surface 12. This fuses or fixes ink image 26 to final receiving surface 21 so that the transferred ink image is spread, flattened, and adhered.

The ink utilized in the process and system of this invention is preferably initially in solid form and is then changed to a molten state by the application of heat energy to raise its temperature to about 85° C. to about 150° C. Elevated temperatures above this range will cause degradation or chemical breakdown of the ink. Molten ink drops are then ejected from the ink jets in printhead 11 to the intermediate transfer surface 12, where they deform to a generally flattened shape upon contact. The molten ink drops then cool to an intermediate temperature and solidify to a malleable state in which they are transferred as ink image 26 to final receiving surface 21 via a contact transfer by entering nip 22 between roller 23 and intermediate transfer surface 12 on drum 14. The intermediate temperature wherein the ink drops are maintained in the malleable state is between about 20° C. to about 60° C. and preferably about 50° C.

Once ink image 26 enters nip 22, it is deformed again to its final image conformation and adheres or is fixed to final receiving substrate 21 by a combination of nip 22 pressure exerted by roller 23 and heat supplied by a media preheater 27 and a drum heater 28. Media preheater 27 is preferably integral with a lower surface of final substrate guide 20. Drum heater 28 is preferably a lamp and reflector assembly oriented to radiantly heat the surface of drum 14. Alternatively, a cylindrical heater may be axially mounted within drum 14 such that heat generated therein is radiated directly and conducted to drum 14 by radial fins 30.

The pressure exerted in nip 22 by roller 23 on ink image 26 is between about 10 to about 1,000 psi, more preferably about 500 psi, which is approximately twice the ink yield strength of 250 psi at 50° C. but much less than the 3,500 psi pressure of post processing fusers. The nip pressure must be sufficient to have ink image 26 adhere to final receiving substrate 21 and be sufficiently flattened to transmit light rectilinearly through the ink image in those instances when final receiving substrate 21 is a transparency. Once adhered to final receiving substrate 21, the ink image is cooled to an ambient temperature of about 20° C. to about 25° C.

Figure 2:
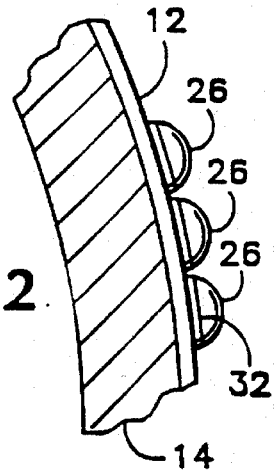
FIG. 2 is an enlarged pictorial schematic diagram showing the liquid layer acting as an intermediate transfer surface supporting the ink.
Figure 3:
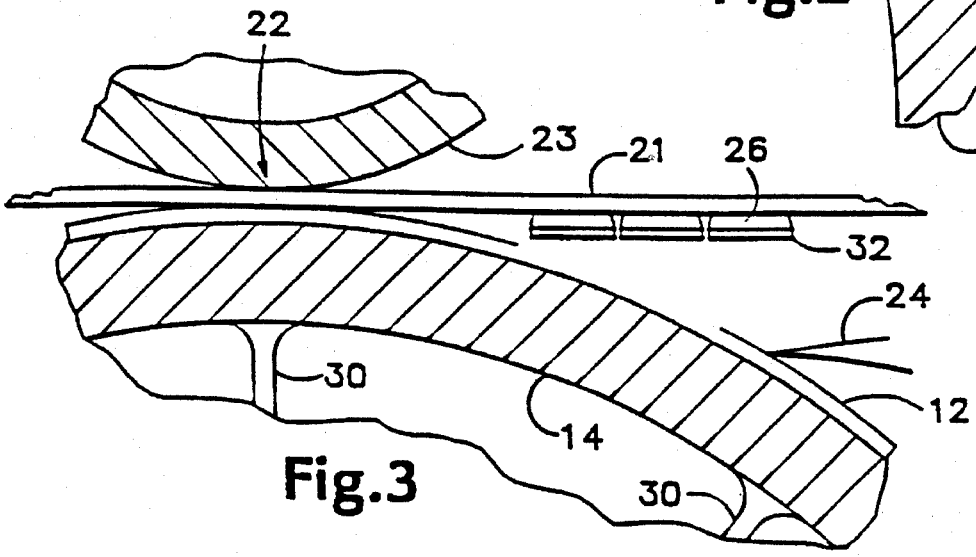
FIG. 3 is an enlarged pictorial schematic diagram showing the transfer of the ink image from the liquid intermediate transfer surface to a final receiving surface.

FIGS. 2 and 3 show the sequence involved when ink image 26 is transferred from intermediate transfer surface 12 to final receiving substrate 21. Ink image 26 transfers to final receiving substrate 21 with a small but measurable quantity of the liquid forming intermediate transfer surface 12 attached thereto as a transferred liquid layer 32. A typical thickness of transferred liquid layer 32 is calculated to be about 100 nanometers. Alternatively, the quantity of transferred liquid layer 32 can be expressed in terms of mass as being from about 0.1 to about 200 milligrams, more preferably from about 0.5 to about 50 milligrams, and most preferably from about 1 to about 10 milligrams per A-4 sized page of final receiving substrate 21. This is determined by tracking on a test fixture the weight loss of the liquid in the applicator assembly 16 at the start of the imaging process and after a desired number of sheets of final receiving substrate 21 have been imaged.

Some appropriately small and finite quantity of intermediate transfer surface 12 is also transferred to the final receiving substrate in areas adjacent to transferred ink image 26. This relatively small transfer of intermediate transfer surface 12 with ink image 26 to the non-imaged areas on the final receiving substrate 21 can permit multiple pages of final receiving substrate 21 to be printed before it is necessary to replenish sacrificial intermediate transfer surface 12. Replenishment may be necessary after relatively few final printed copies, depending on the quality and nature of final receiving surface 21 that is utilized. Transparency film and paper are the primary intended media for image receipt. "Plain paper" is the preferred medium, such as that supplied by Xerox Corporation and many other companies for use in photocopy machines and laser printers. Many other commonly available office papers are included in this category of plain papers, including typewriter grade paper, standard bond papers, and letterhead paper. Xerox® 4024 paper is assumed to be a representative grade of plain paper for the purposes of this invention. A suitable transparency film is type No. CG3300 manufactured by 3M Corporation.

Suitable liquids that may be employed for intermediate transfer surface 12 include water, fluorinated oils, glycol, surfactants, mineral oil, silicone oil, functional oils, or combinations thereof. Functional oils can include, but are not limited to, mercapto-silicone oils, fluorinated silicone oils, and the like.

The ink used to form ink image 26 preferably must have suitable specific properties for viscosity. Initially, the viscosity of the molten ink must be matched to the requirements of the ink-jet device utilized to apply it to intermediate transfer surface 12 and optimized relative to other physical and rheological properties of the ink as a solid, such as yield strength, hardness, elastic modulus, loss modulus, ratio of the loss modulus to the elastic modulus, and ductility. The viscosity of the phase-change ink carrier composition has been measured on a Ferranti-Shirley Cone Plate Viscometer with a large cone. At about 140° C. a preferred viscosity of the phase-change ink carrier composition is from about 5 to about 30 centipoise, more preferably from about 10 to about 20 centipoise, and most preferably from about 11 to about 15 centipoise. The surface tension of suitable inks is between about 23 and about 50 dynes/cm. An appropriate ink composition is described in U.S. Pat. No. 4,889,560 issued Dec. 26, 1989 for PHASE CHANGE INK COMPOSITION AND PHASE CHANGE INK PRODUCED THEREFROM, which is assigned to the assignee of this invention and incorporated herein by reference.

The phase change ink used in this invention is formed from a phase-change ink carrier composition that exhibits excellent physical properties. For example, the subject phase change ink, unlike prior art phase change inks, exhibits a high level of lightness, chroma, and transparency when utilized in a thin film of substantially uniform thickness. This is especially valuable when color images are conveyed using overhead projection techniques. Furthermore, the preferred phase-change ink compositions exhibit the preferred mechanical and fluidic properties mentioned above when measured by dynamic mechanical analyses ("DMA"), compressive yield testing, and viscometry. More importantly, these work well when used in the printing process of this invention utilizing a liquid layer as the intermediate transfer surface. The phase-change ink composition and its physical properties are discussed in greater detail in co-pending U.S. patent application Ser. No. 07/981,677, filed Nov. 25, 1992 for PROCESS FOR APPLYING SELECTIVE PHASE CHANGE INK COMPOSITIONS TO SUBSTRATES IN INDIRECT PRINTING PROCESSES, now U.S. Pat. No. 5,372,852 which is assigned to the assignee of this invention and incorporated herein by reference.

The above-defined DMA properties of the phase-change ink compositions were experimentally determined. These dynamic measurements were done on a Rheometrics Solids Analyzer model RSA II manufactured by Rheometrics, Inc. of Piscataway, N.J., using a dual cantilever beam geometry. The dimensions of the sample were about 2±1 mm thick, about 6.5±0.5 mm wide, and about 54±1 mm long. A time/cure sweep was carried out under a desired force oscillation or testing frequency of about 1 KHz and an auto-strain range of about $1\times10^{-5}$ percent to about 1 percent. The temperature range examined was about −60° C. to about 90° C. The preferred phase-change ink compositions typically are (a) flexible at a temperature of about −10° C. to about 80° C.; (b) have a temperature range for the glassy region from about −100° C. to 40° C., the value of E' being from about $1.5\times10^{9}$ to $1.5\times10^{11}$ dyne/cm$^2$; (c) have a temperature range for the transition region from about −30° C. to about 60° C.; (d) have a temperature range for the rubbery region of E' from about −10° C. to 100° C., the value of E' being from about $1\times10^{6}$ to $1\times10^{11}$ dyne/cm$^2$; and (e) have a temperature range for the terminal region of E' from about 30° C. to about 160° C. Furthermore, the glass transition temperature range of the phase-change ink compositions are from about −40° C. to about 40° C., the temperature range for integrating under the tan δ peak of the phase-change ink composition is from about −80° C. to about 80° C. with integration values ranging from about 5 to about 40, and the temperature range for the peak value of tan δ of the phase-change ink is from about −40° C. to about 40° C. with a tan δ of about $1\times10^{-2}$ to about 1×10 at peak.

Figure 4:
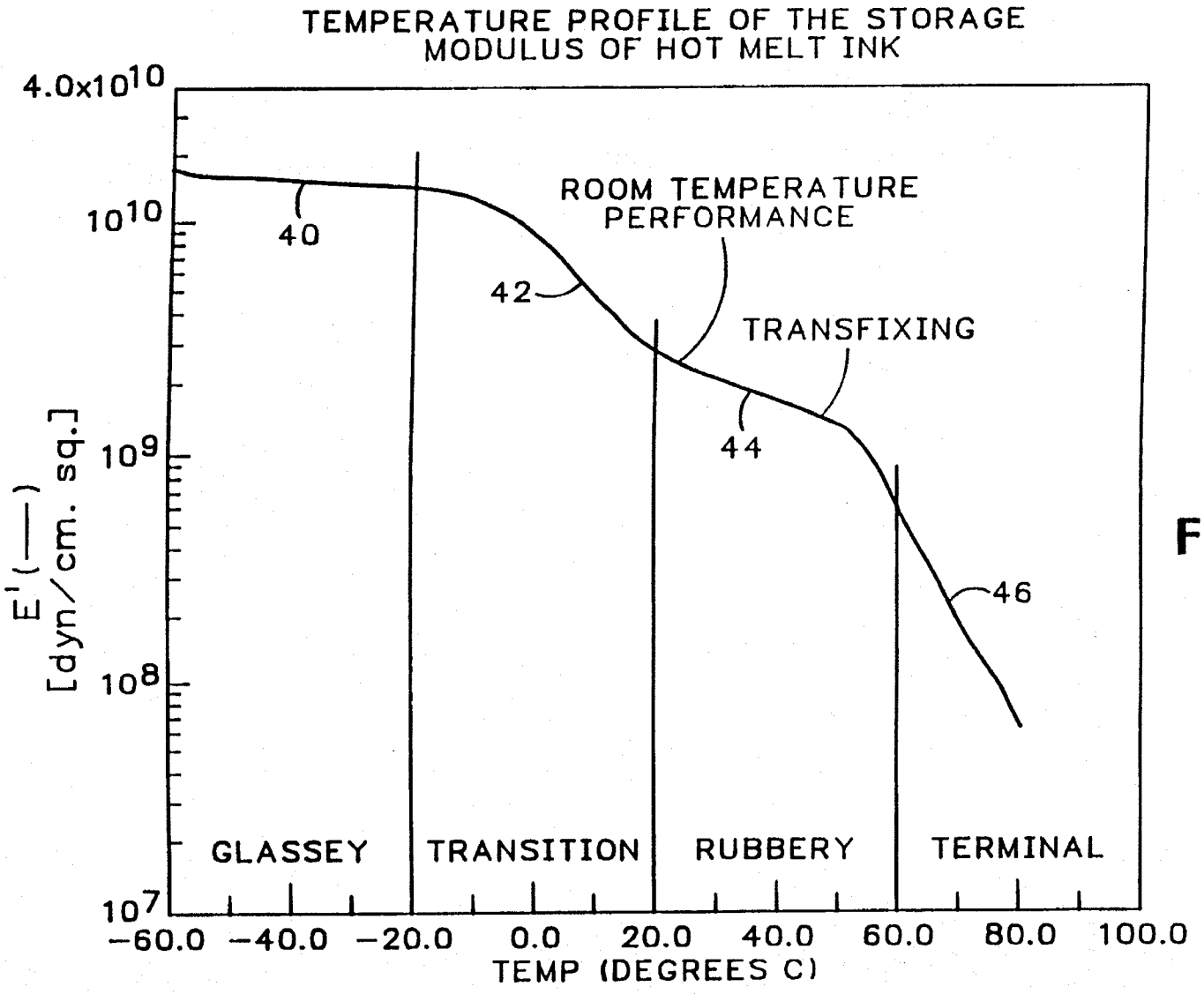
FIG. 4 is a graph showing storage modulus as a function of temperature for a phase-change ink suitable for use with this invention.

FIG. 4 shows a representative graph of a storage modulus E' as a function of temperature at 1 Hz for a phase-change ink composition suitable for use in the printing process of this invention. The graph indicates that storage modulus E' is divided into a glassy region 40, a transition region 42, a rubbery region 44, and a terminal region 46.

In glassy region 40 the ink behaves similar to a hard, brittle solid, i.e., E' is high, about $1\times10^{10}$ dyne/cm$^2$. This is because in this region there is not enough thermal energy or sufficient time for the molecules to move. This region needs to be well below room temperature so the ink will not be brittle and affect its room temperature performance on paper.

In transition region 42 the ink is characterized by a large drop in the storage modulus of about one order of magnitude because the molecules have enough thermal energy or time to undergo conformational changes. In this region, the ink changes from being hard and brittle to being tough and leathery.

In rubbery region 44 the storage modulus change is shown as a slightly decreasing plateau. In this region, there is a short-term elastic response to the deformation that gives the ink its flexibility. It is theorized that the impedance to motion or flow in this region is due to entanglements of molecules or physical cross-links from crystalline domains. Producing the ink to obtain this plateau in the appropriate temperature range for good transfer and fixing and room temperature performance is important when formulating these phase-change ink compositions. Rubbery region 44 encompasses the ink in both its malleable state during the transfer and fixing or fusing step and its final ductile state on the final receiving substrate.

Finally, in terminal region 46, there is another drop in the storage modulus. It is believed that in this region the molecules have sufficient energy or time to flow and overcome their entanglements.

Several phase-change ink compositions were analyzed by compressive yield testing to determine their compressive behavior while undergoing temperature and pressure in nip 22. The compressive yield strength measurements were done on an MTS SINTECH 2/D mechanical tester manufactured by MTS Sintech, Inc. of Cary, N.C., using small cylindrical sample blocks. The dimensions of a typical sample are about 19±1 mm by about 19±1 mm.

Isothermal yield stress was measured as a function of temperature (about 25° C. to about 80° C.) and strain rate. The material was deformed up to about 40 percent.

The preferred yield stresses as a function of temperature for suitable phase-change ink compositions for use in the indirect printing process of this invention are described by an equation YS=mT+I, where YS is the yield stress as a function of temperature, m is the slope, T is the temperature, and I is the intercept.

Under nonprocess conditions, i.e., after the final printed product is formed, or conditions under which the ink sticks are stored, and the ink is in a ductile state or condition at a temperature range of from at least about 10° C. to about 60° C., the preferred yield stress values are described by m as being from about −9±2 psi/°C. to about −36±2 psi/°C. and I as being from about 800±100 psi to about 2,200±100 psi. More preferably, m is about −30±2 psi/°C., and I is about 1,700±100 psi.

Under process conditions, i.e., during the indirect printing of the ink from an intermediate transfer surface onto a substrate while the ink is in a malleable solid condition or state, at a temperature of from at least about 20° C. to about 80° C., the preferred stress values are described by m as being from about −6±2 psi/°C. to about −36±2 psi/°C. and I as being from about 800±100 psi to about 1,600±100 psi. More preferably, m is about −9±2 psi/°C., and I is about 950±100 psi.

Figure 5:
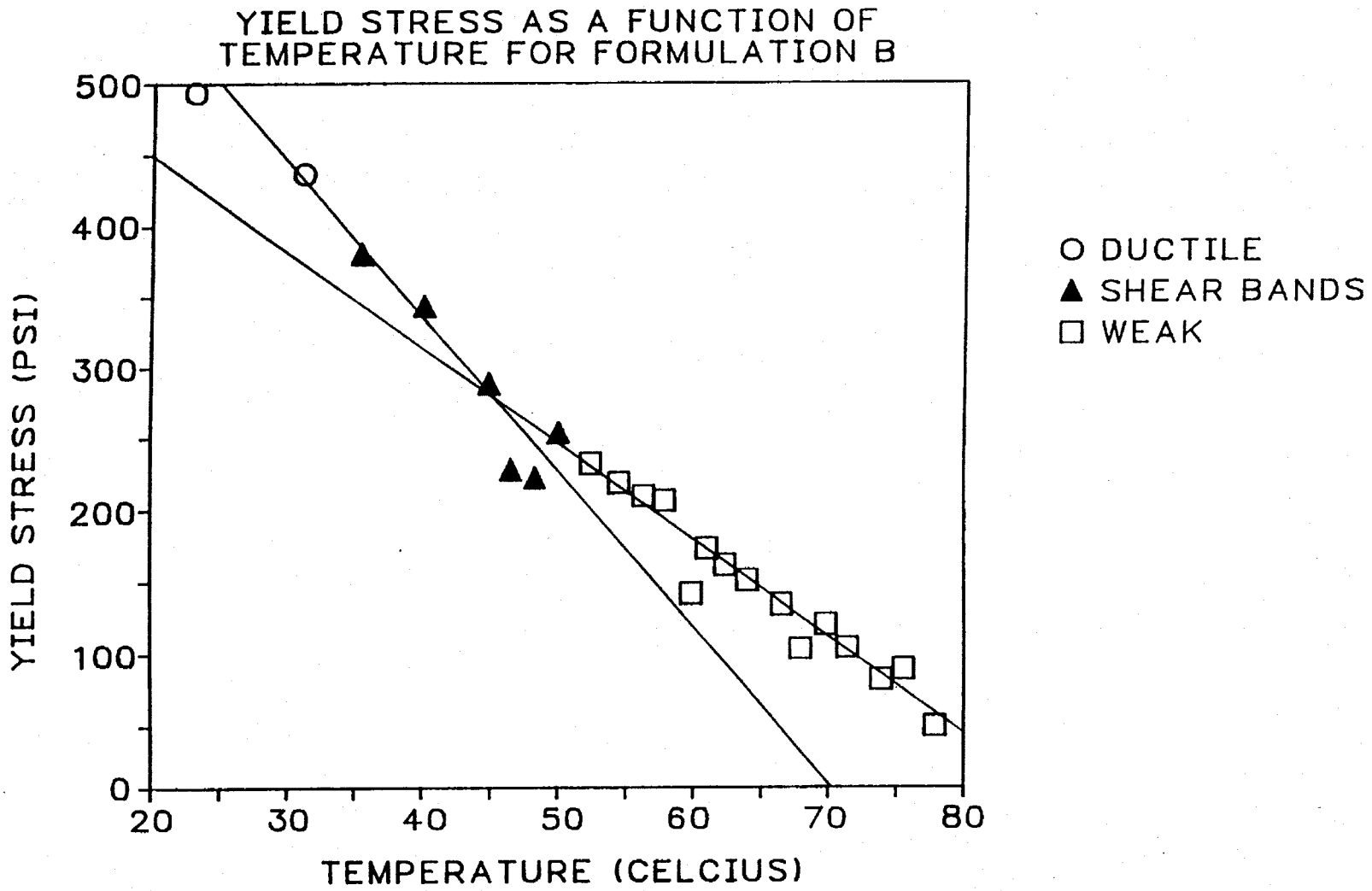
FIG. 5 is a graph showing yield stress as a function of temperature for a phase-change ink suitable for use with this invention.

FIG. 5 shows the yield stress of a suitable phase-change ink as a function of temperature. When subjected to a temperature range of from about 35° C. to about 55° C., the ink will begin to yield (compress) when subjected to a corresponding pressure in a range of from about 200 psi to about 400 psi. Optimal nip pressure is about two times the yield stress pressure of the ink at any particular nip temperature. For example, for a 50° C. yield stress of 250 psi, the nip pressure should be about 500 psi. However, as described with reference to FIGS. 6–10, print quality depends more on various temperature-related parameters than on nip pressure.

Referring again to FIG. 1, during printing, drum 14 has a layer of liquid intermediate transfer surface applied to its surface by the action of applicator assembly 16. Assembly 16 is raised by an appropriate mechanism (not shown), such as an air cylinder, until wicking pad 15 is in contact with the surface of drum 14. The liquid is retained within reservoir 18 and passes through the porous supporting material until it saturates wicking pad 15 to permit a uniform layer of desired thickness of the liquid to be deposited on the surface of drum 14. Drum 14 rotates about a journalled shaft in the direction shown in FIG. 1 while drum heater 28 heats the liquid layer and the surface of drum 14 to the desired temperature. Once the entire periphery of drum 14 has been coated, applicator assembly 16 is lowered to a noncontacting position with intermediate transfer surface 12 on drum 14. Alternately, drum 14 can be coated with liquid intermediate transfer surface 12 by a web through which the liquid is transmitted by contact with a wick. The wick is wetted from a reservoir containing the liquid.

Ink image 26 is applied to intermediate transfer surface 12 by printhead 11. The ink is applied in molten form, having been melted from its solid state form by appropriate heating means (not shown). Ink image 26 solidifies on intermediate transfer surface 12 by cooling to a malleable solid intermediate state as the drum continues to rotate, entering nip 22 formed between roller 23 and the curved surface of intermediate transfer surface 12 supported by drum 14. In nip 22, ink image 26 is deformed to its final image conformation and adhered to final receiving surface 21 by being pressed against surface 21. Ink image 26 is thus transferred and fixed to the final receiving surface 21 by the nip pressure exerted on it by the resilient or elastomeric surface of the roller 23. Stripper fingers 24 help to remove the imaged final receiving surface 21 from intermediate transfer surface 12 as drum 14 rotates. Ink image 26 then cools to ambient temperature where it possesses sufficient strength and ductility to ensure its durability.

Applicator assembly 16 is actuatable to raise upward into contact with drum 14 to replenish the liquid forming sacrificial intermediate transfer surface 12. Actuator assembly 16 can also function as a cleaner if required to remove lint, paper dust or, for example, ink, should abnormal printing operation occur.

A proper set of image transfer conditions is dependent on a complexly interrelated set of parameters related to nip pressure, preheater and drum temperature, media time in nip 22, and ink parameters. Any particular set of transfer conditions that provide acceptable prints is referred to as a process window.

The process window is determined experimentally by running test prints under sets of controlled transfer conditions. The test prints were made using some fixed control parameters. For instance, a diamond-turned unsealed anodized aluminum drum was used, which is the preferred drum 14. Roller 23 was a typewriter platen having an elastomeric surface with a Shore D hardness and/or durameter of 40 to 45. Each end of roller 23 was biased toward drum 14 with a 350-pound force resulting in an average nip pressure of about 463 psi. The receiving substrate 21 was Hammermill Laser Print paper. Xerox® type 4024 paper may also be used but is not preferred for test prints. The liquid forming intermediate transfer surface 12 was 1,000 cSt silicone oil. Final receiving medium 21 was moved through nip 22 at a velocity of about 13 cm/second. The velocity, which is determined by drum 14 rotation speed, is not fully understood. However, the ink temperature in nip 22 substantially reaches equilibrium in about 2 to 6 milliseconds.

The process for forming intermediate transfer surface 12 on drum 14 entails pressing an oil pad against rapidly rotating drum 14 until lines of oil can be seen on drum 14. The oil is then wiped or buffed off drum 14 by applying a Kaydry wiping cloth for two seconds against drum 14 and then for five seconds across the drum. This method of applying intermediate transfer surface 12 is closely duplicated by applicator assembly 16.

Sets of test prints were made for various combinations of the temperature of media preheater 27 and the temperature of drum 14.

Four primary factors determine the process window: fuse grade, pixel picking, dot spread, and high temperature limit. Test prints were made as described below to determine temperature ranges for each factor.

Fuse grade is a number proportional to the amount of ink that is physically pressed into paper fibers during the transfer printing process. Fuse grade is quantified by first imaging drum 14 with 4×4 cm squares of blue colored image. The blue colored squares are formed by depositing superimposed layers of cyan and magenta ink onto intermediate transfer surface 12 of drum 14. The blue colored squares are then transferred to final receiving medium 21 as it passes through nip 22. A knife edge is used to scrape the ink from a blue colored square transferred to each test print. An ACS Spectro-Sensor II spectrophotometer measures the optical density (reflectance) of the scraped area and compares it to a blank (white) area of the test print. The reflectance value is the fuse grade, which is proportional to the amount of ink remaining (fused) in the test print. The higher the fuse grade, the higher the optical density of the tested area. An acceptable minimum fuse grade is 20.

Figure 6:
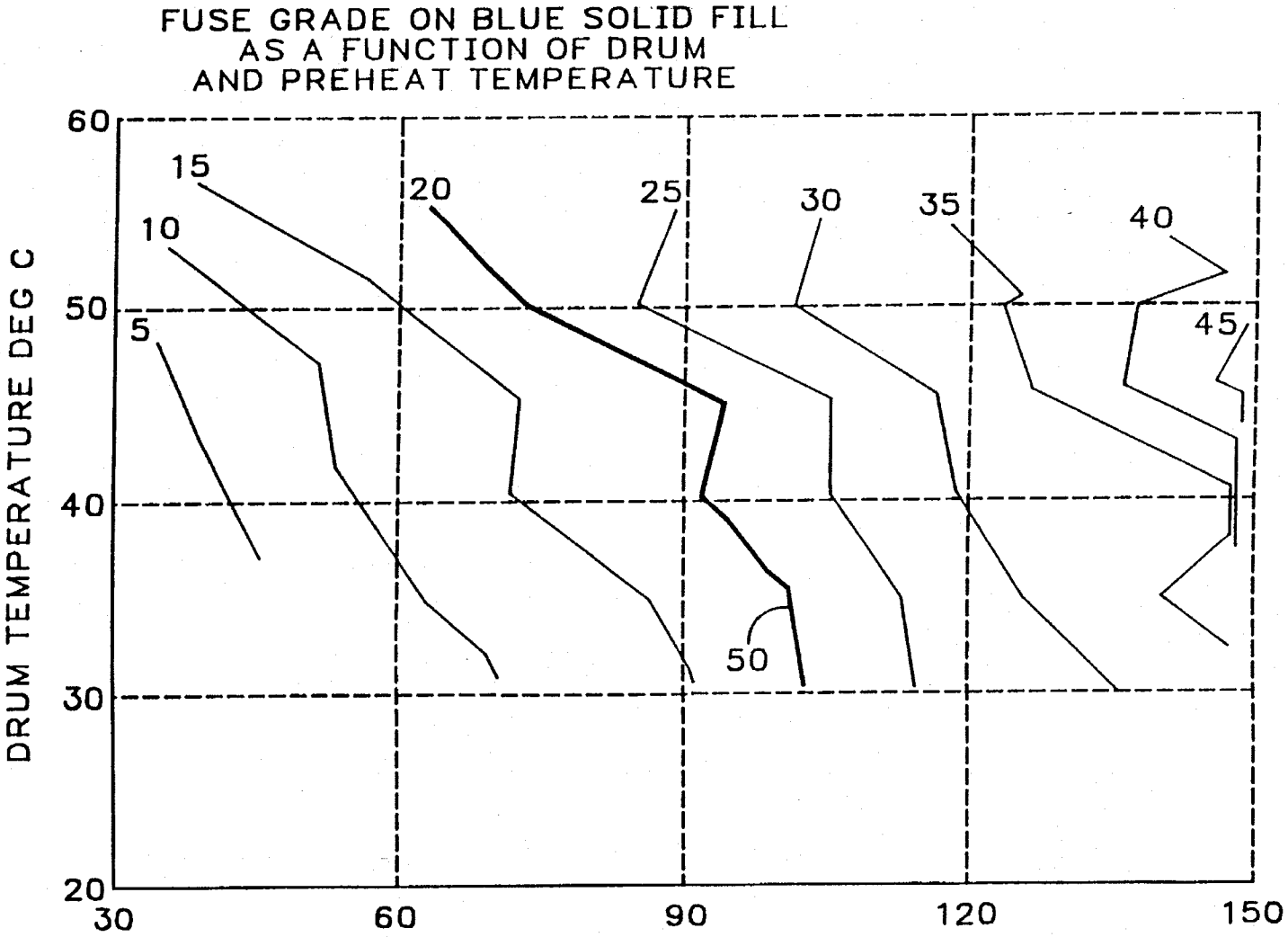
FIG. 6 is a graph showing fuse grade as a function of media preheater and drum temperature as determined from a set of fuse grade test prints made to determine a process window according to this invention.

Fuse grade test print data are shown in FIG. 6, which plots iso-fuse grade lines as a function of drum temperature and media preheater temperature. The relatively vertical orientation of the iso-fuse grade lines indicates that fuse grade is more dependent on the temperature of media preheater 27 than on the temperature of drum 14. An iso-fuse grade line 50 (shown in bold) delimits a left margin of a temperature region in which the fuse grade equals or exceeds the minimum acceptable value of 20.

Pixel picking is a factor that relates to the percentage of ink droplets that are transferred from drum 14 to final receiving media 21 during the transfer printing process. A pixel picking percentage is determined by first imaging drum 14 with a blue color filled field, formed by overprinting cyan and magenta inks on the drum 14 and having 475 unprinted squares each measuring a 3×3 pixel square area. A single black ink drop or pixel is deposited in the center of each unprinted 3×3 pixel square area. The resulting image is then transferred to final receiving medium 21 as it passes through nip 22. All of the double-layered blue colored filled field area transfers, but the single layered 475 black drops within the field are recessed below the blue filled field and are particularly difficult to transfer. The percentage of black drops that transfer is the pixel picking percentage with 80 percent being an acceptable level. Black ink drops not transferred when the test print passes through nip 22 are easily transferred to a second "chaser sheet" of final receiving medium 21 where they are counted to determine the pixel picking percentage.

Figure 7:
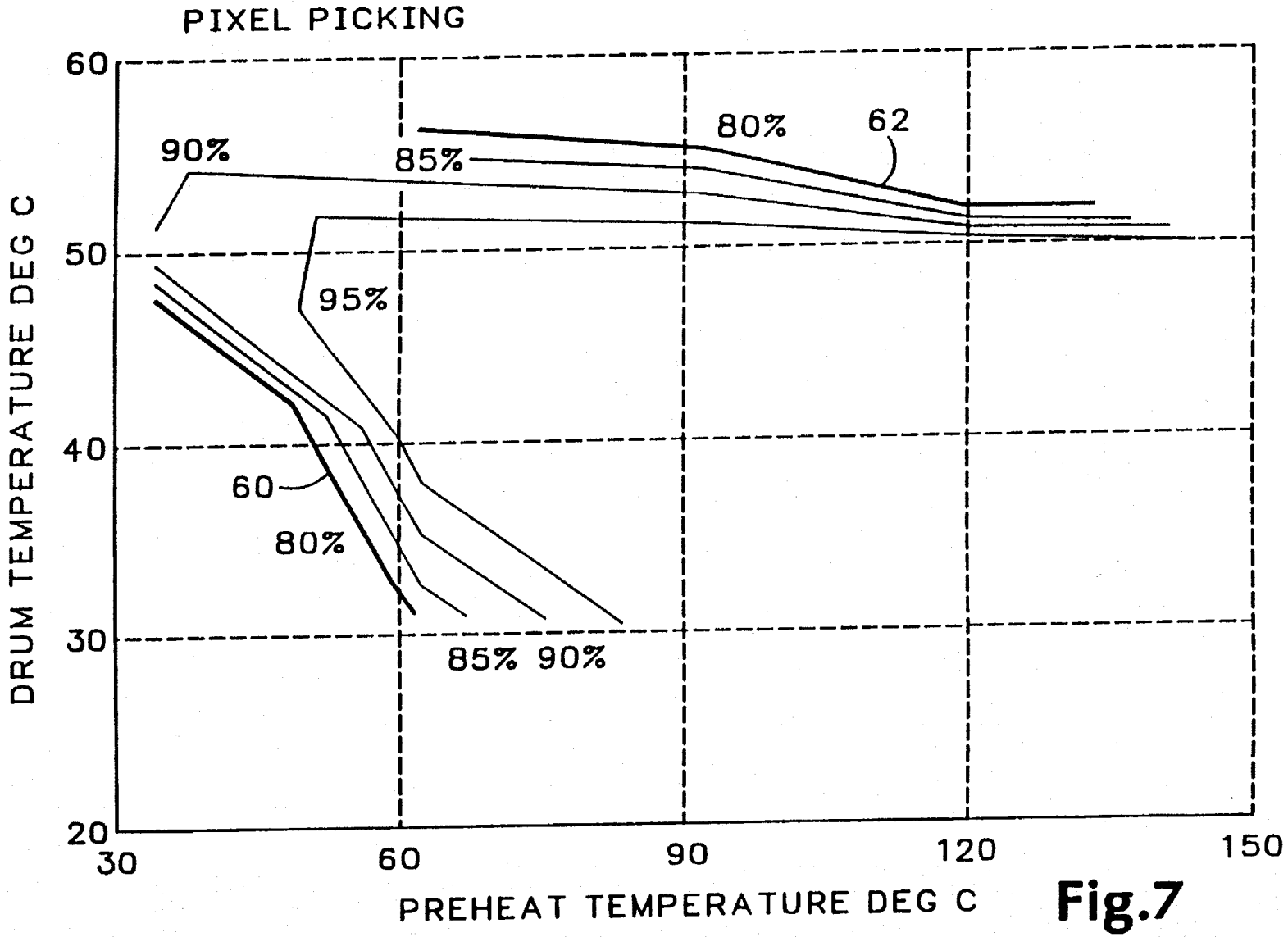
FIG. 7 is a graph showing pixel picking percentage as a function of media preheater and drum temperature as determined from a set of pixel picking test prints made to determine a process window according to this invention.

Pixel picking test print and chaser sheet data are shown in FIG. 7, which plots iso-pixel picking percentage lines as a function of drum temperature and media preheater temperature. Iso-pixel picking percentage lines 60 and 62 (shown in bold) delimit respective left and top margins of a temperature region in which the pixel picking percentage equals or exceeds 80 percent. The graph shows that below about 50° C. pixel picking depends mostly on media preheater 27 temperature, whereas above about 50° C. pixel picking depends mostly on the temperature of drum 14.

Dot spread is classified into six groups related to the degree to which adjacent ink drops (pixels) flatten and blend together to cover final receiving medium 21 during the transfer printing process. Dot spread groups are quantified by first imaging drum 14 with 4×4 cm squares of magenta ink. The magenta squares are formed by depositing a single layer of magenta ink onto intermediate transfer surface 12 of drum 14. Each square consists of ink drops deposited on drum 14 at a uniform spacing defined by the 118 pixel/cm addressability of the test printer. The deposited ink drops have a smaller diameter than the pixel-to-pixel spacing before they are compressed in nip 22. The magenta squares are then transferred to final receiving medium 21 as it passes through nip 22. The process is repeated under various combinations of media preheater 27 and drum 14 temperatures to yield a set of test prints that are inspected under a microscope and sorted into three subjective groups including poor spread, medium spread, and good spread. Poor spread (groups 1 and 2) is defined as the ability to see individual pixels and/or the white lines between adjacent rows of pixels. Medium spread (groups 3 and 4) is defined as the ability to see parts of white lines between adjacent rows of pixels. Good spread (groups 5 and 6) is defined as viewing a solid sheet of ink with no white paper showing through the transferred image. Each of the three print groups was then subdivided into the better and worse prints of each group. Although solid fill areas appear to have a higher print quality with the higher dot spread group numbers, text becomes blurry because of reduced printing resolution. Dot spread groups 4 and 5 strike an acceptable balance between good solid fill and text quality.

Figure 8:
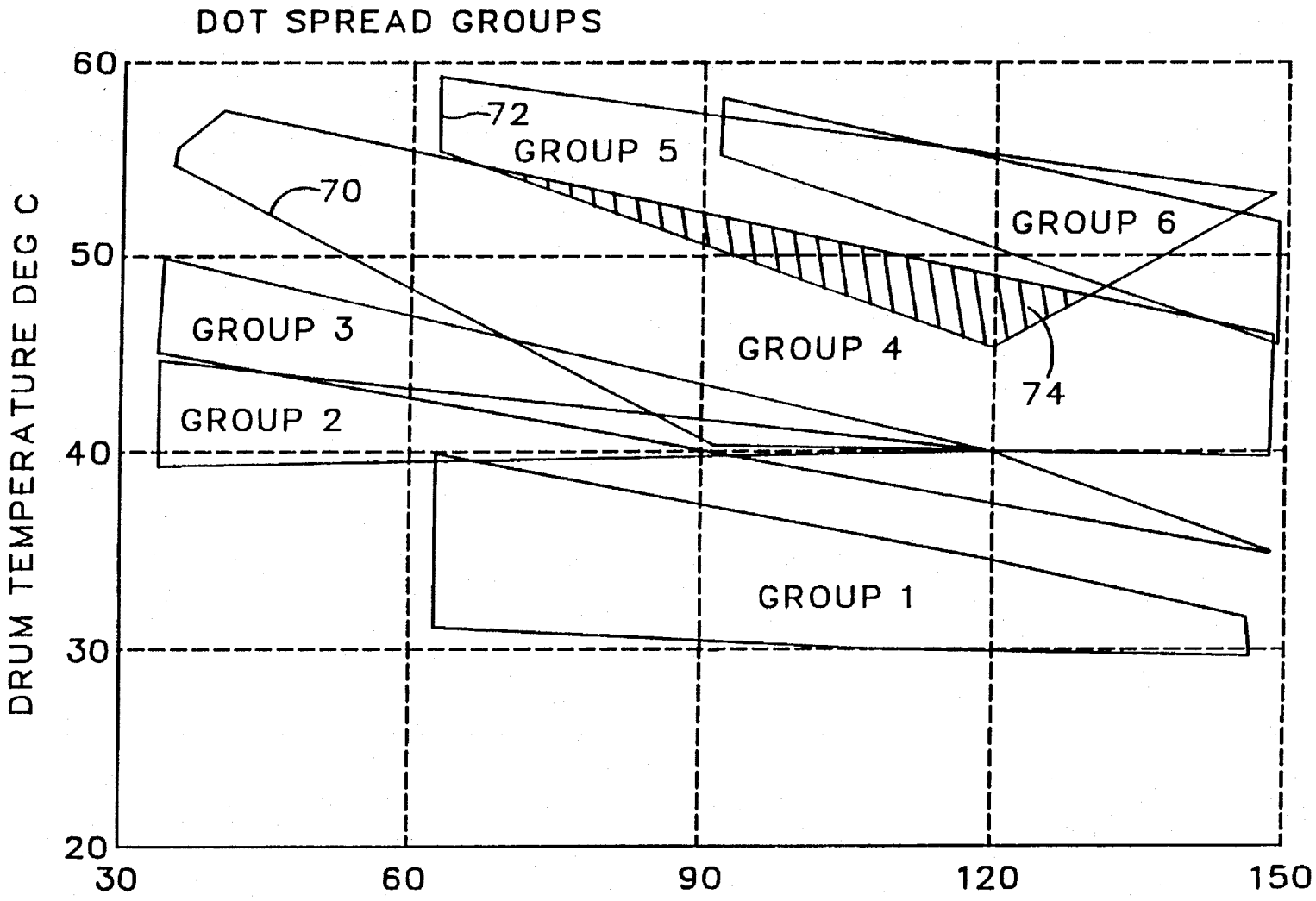
FIG. 8 is a graph showing dot spread groups as a function of media preheater and drum temperature as determined from a set of drop spread test prints made to determine a process window according to this invention.

Dot spread test print data are shown in FIG. 8, which plots dot spread group regions as a function of drum temperature and media preheater temperature. Dot spread groups 4 and 5 are bounded by respective outlines 70 and 72 (shown in bold), the outer extents of which delimit a temperature region within which the dot spreading is acceptable. The relatively horizontal orientation of the dot spread groups indicates that dot spreading is more dependent on the temperature of drum 14 than on the temperature of media preheater 27. A region 74 (shown cross-hatched) encompasses the optimized temperature region shared by dot spread groups 4 and 5. The dot spread groups shown in FIG. 8 are outlines of the extreme data points from each group. Because dot spread groups are determined by a subjective measurement, some overlap exists among the groups and the extremes are only approximate.

The high temperature limit is defined as the maximum drum temperature at which ink image 26 can be transferred from drum 14 without some of the ink drops tearing apart because of cohesive failure, tearing apart from each other because of adhesive failure, or sticking to drum 14 because of a low yield stress as shown in FIG. 5. The high temperature limit is dominated by cohesive failure, which is quantified by first imaging drum 14 with 4×4 cm colored squares of cyan, magenta, yellow, black, green, blue and red ink. The colored squares are formed by depositing the appropriate number of single or overprinted layers of primary inks (cyan, magenta, yellow and black) onto intermediate transfer surface 12 of drum 14. The colored squares are then transferred to final receiving medium 21 as it passes through nip 22. A set of test prints are transferred with various temperature combinations of media preheater 27 and drum 14. Cohesive failure is usually observed on edges of the colored squares and is most easily observed as print remnants left on a chaser or cleaning sheet. Acceptable prints require substantially no cohesive failure.

Figure 9:
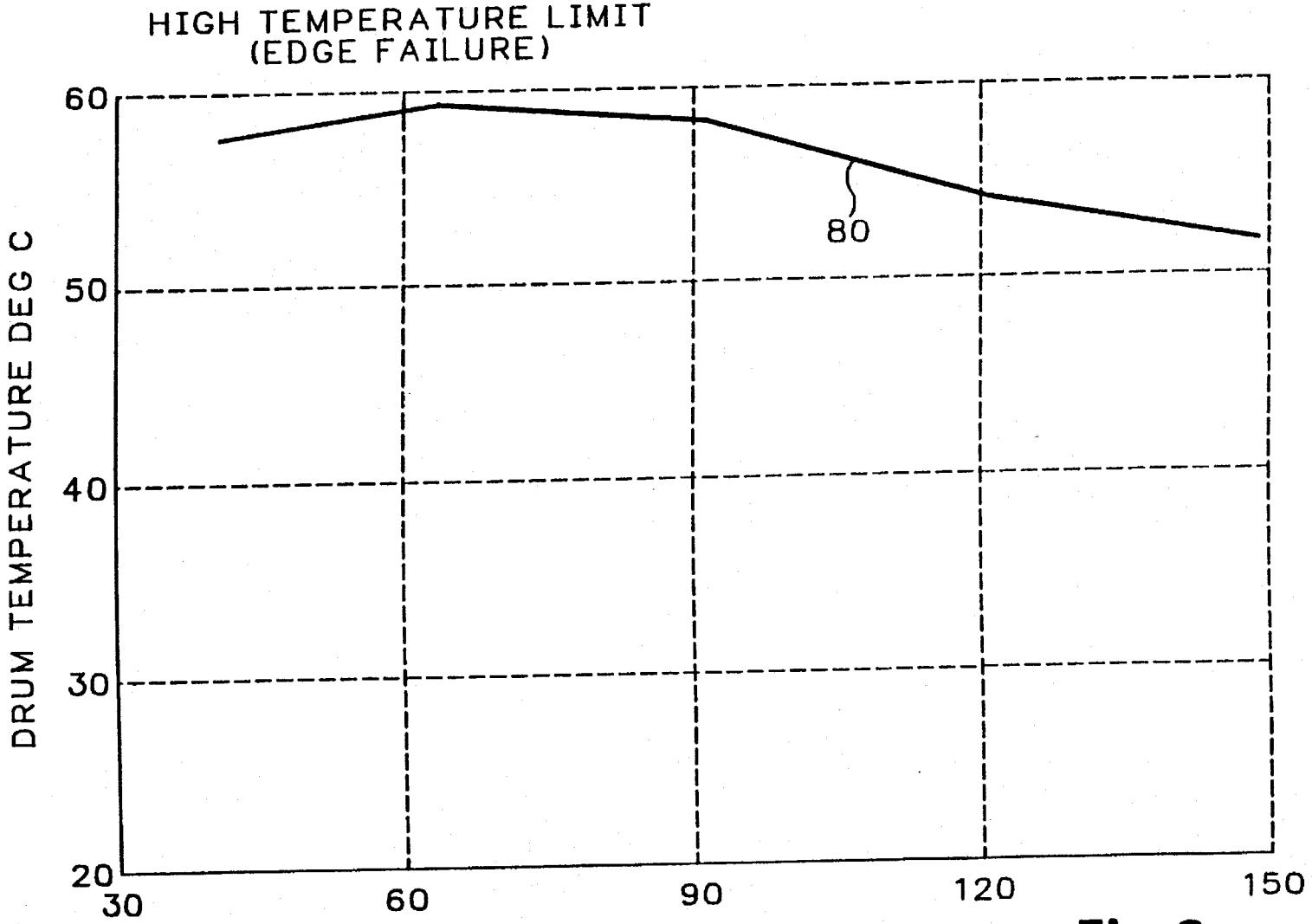
FIG. 9 is a graph showing high temperature limit as a function of media preheater and drum temperature as determined from a set of ink cohesive failure test prints made to determine a process window according to this invention.

High temperature limit test print data are shown in FIG. 9, which plots the cohesive failure as a function of drum temperature and media preheater temperature. A high temperature limit line 80 (shown in bold) delimits a top margin of a temperature region below which the ink will not undergo cohesive failure. The relatively horizontal orientation of line 80 shows that the high temperature limit is almost completely dependent on the temperature of drum 14.

However, the high temperature limit is an approximate value because cohesive failure is dependent on the test image, ink color, ink composition, and characteristics of intermediate transfer surface 12. In particular, using other than a solid fill test image has caused cohesive failure at lower temperatures than those resulting from the yellow squares image. At temperatures approaching the high temperature limit, it is theorized that intermediate transfer surface 12 becomes a factor in determining cohesive failure if an insufficient amount of the liquid forming the surface is on drum 14. Drum surface roughness also affects cohesive failure.

Figure 10:
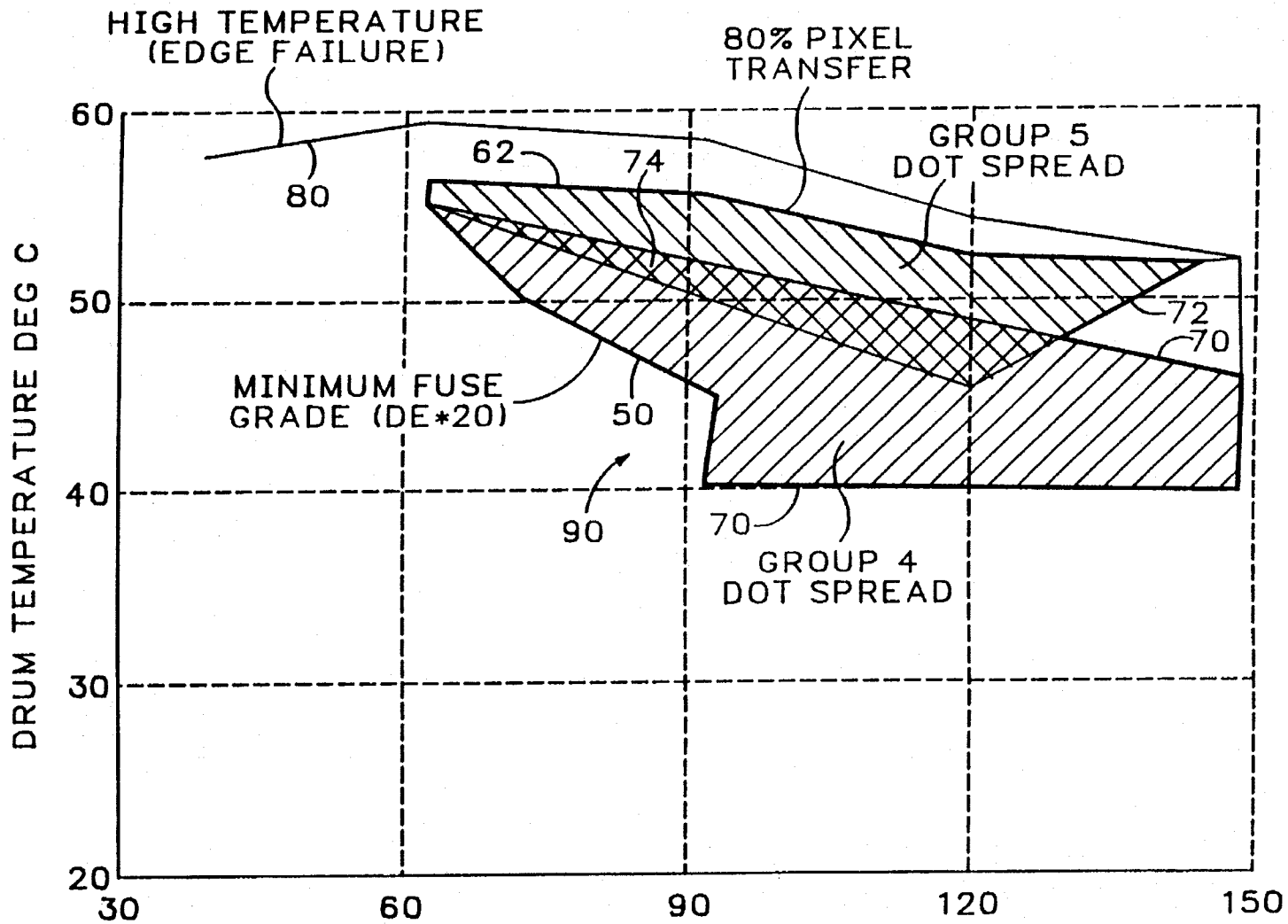
FIG. 10 is a graph showing a phase-change transfer printing process window for a specific ink formulation as bounded by the parameter limits shown in FIGS. 6–9.

FIG. 10 shows a process window 90 that is defined by overlaying the data of FIGS. 6–9. Process window 90 has a left margin bounded by iso-fuse grade 20 (line 50 of FIG. 6), an upper margin bounded by 80 percent iso-pixel picking (line 62 of FIG. 7), a right margin bounded by dot spread groups 4 and 5 (outlines 70 and 72 of FIG. 8), and a lower margin bounded by dot spread group 4 (outline 70 of FIG. 8). The upper margin of process window 90 is a few degrees C. below the high temperature limit (line 80 of FIG. 9).

Knowing process window 90 is useful for deriving the thermal specifications and tolerances required for obtaining acceptable prints from a phase change ink intermediate surface transfer printer. In particular, media preheater 27, drum heater 28, power requirements, warm-up times, and cooling requirements can be determined. Process window 90 should have widely separated temperature boundaries to accommodate thermal mass variations and temperature nonuniformities associated with drum 14, media preheater 27, and roller 23.

Referring again to FIG. 1, for the above-described ink and imaging apparatus 10, a desirable media preheater 27 temperature range is from about 60° C. to about 150° C. and a desirable drum 14 temperature range is from about 40° C. to about 56° C. Operation in the window of optimized temperature transfer conditions is preferred and entails a media preheater 27 temperature range of from about 61° C. to about 130° C. and a drum 14 temperature range of from about 45° C. to about 55° C. A more preferred operational temperature range for drum 14 is between about 46° C. and about 54° C.

Maintaining drum 14 within the temperature limits defined by process window 90 may require heating drum 14 during periods of no printing and will require cooling drum 14 during periods of printing. Cooling is required during printing because heat is transferred by preheated media contacting drum 14 in nip 22, by printhead 11 depositing molten ink on drum 14, and by radiation from heated printhead 11. Heating or cooling during periods of no printing may be required because radiation from heated printhead 11 may not maintain drum 14 at the desired printing temperature.

Figure 11:
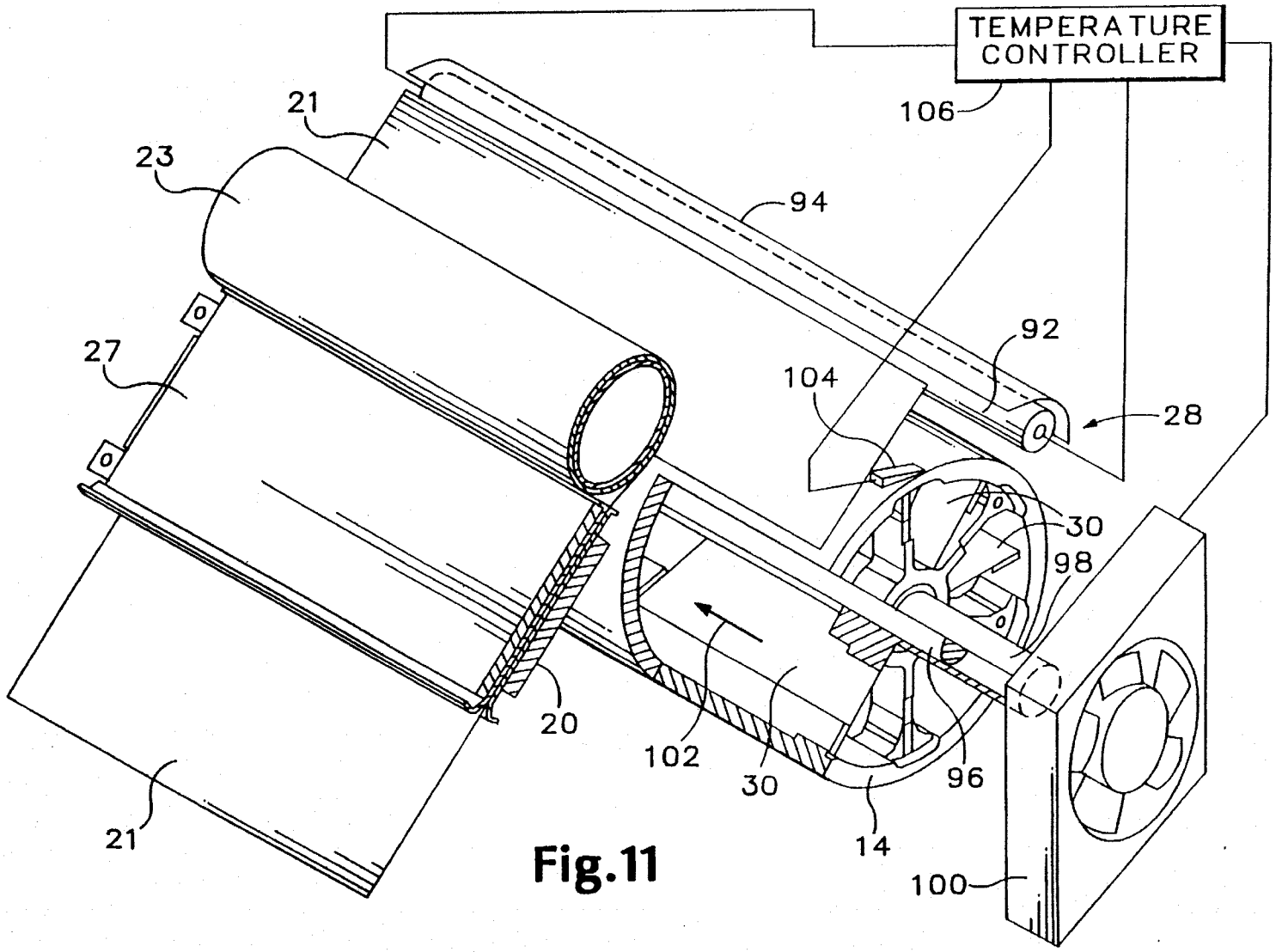
FIG. 11 is an isometric schematic pictorial diagram showing a media preheater, roller, print medium, drum, drum heater, fan, and temperature controller of this invention with the drum shown partly cut away to reveal cooling fins positioned therein.

Referring to FIG. 11, heat is added to drum 14 by drum heater 28 that preferably consists of a heater lamp 92 and reflector 94. Heater lamp 92 is of an infrared heating lamp type such as model No. QIR100-200TN1 manufactured by Ushio Corporation in Newberg, Oreg.

An alternate embodiment for drum heater 28 consists of a cylindrical cartridge or radiant lamp heater 96 axially mounted inside or adjacent to a hollow drum shaft 98. In this embodiment, heat from heater 96 is radiated directly and conducted to drum 14 by radial fins 30. In this embodiment, heat from heater 96 is radiated directly and conducted to drum 14 by radial fins 30.

Drum 14 is cooled by moving air across radial fins 30 with a fan 100. Of course, fan 100 may blow or draw air in either direction through drum 14 to accomplish cooling. Preferably, fan 100 blows air through drum 14 in a direction indicated by an arrow 102. Fan 100 is preferably of a type such as model No. 3610ML-05W-B50 manufactured by N.M.B. Minibea, Co., Ltd. in Japan.

Media preheater 27 is set to a predetermined operating temperature by conventional thermostatic means. Drum temperature, however, is sensed by a thermistor 104 that slidably contacts drum 14 and is electrically connected to a conventional proportional temperature controller 106. When printing, heat is added to drum 14, which causes its temperature to exceed a predetermined temperature that is sensed by thermistor 104. In response, temperature controller 106 decreases electrical drive power to drum heater 28 and turns on fan 100 to return drum 14 temperature to its set point. Conversely, when not printing, thermistor 104 senses a decrease in temperature below the set point. In response, temperature controller 106 turns off fan 100 and adds power to drum heater 28. Depending on the rate of cooling or heating required, temperature controller 106 may proportionally control one or both of drum heater 28 and fan 100. Small temperature changes primarily entail temperature controller 106 altering the amount of electrical power supplied to drum heater 28.

Referring to FIG. 1, it was previously believed that ink drop flattening and spreading occurred primarily during the transfer in nip 22 of ink image 26 to final receiving substrate 21. However, during generation of the above-described test prints (FIGS. 6–9), there were many occasions when ink drops remained adhered to and had to be washed off drum 14 before additional test prints could be made. Upon close inspection, it was discovered that the ink drops washed off drum 14 were flatter than expected. This observation led to experiments to quantify the factors influencing ink drop flattening on drum 14 prior to transfer of ink image 26 in nip 22.

Ink drop flattening is believed to be a function of three main factors: (1) the thickness and viscosity of the liquid forming intermediate transfer surface 12, (2) the temperature of the ink drops and intermediate transfer surface 12, and (3) the energy transfer of the ink drops as they contact intermediate transfer surface 12. Most of these factors are known from the above-described process window determining experiments. The remaining factors were determined as described below.

Kinetic energy equals one-half the ink drop mass times its velocity squared. Printhead 11 is known to eject drops at a velocity of about 2 meters per second. Drop velocity nominally ranges between about 1 and about 6 meters per second. Drop mass is quantified by first imaging drum 14 with a 70,000 ink drop strip of magenta ink covered with a well converged 70,000 ink drop strip of yellow ink to form a red test strip and then transferring the test strip image to a preweighed final receiving medium. The final receiving medium was weighed again to determine the mass of the 140,000 transferred ink drops, which was 16.54 milligrams. Therefore, the mass of each ink drop was calculated to be about 118 nanograms and the kinetic energy of each drop is about 2.36 $(10)^{-3}$ ergs.

Figure 12A:
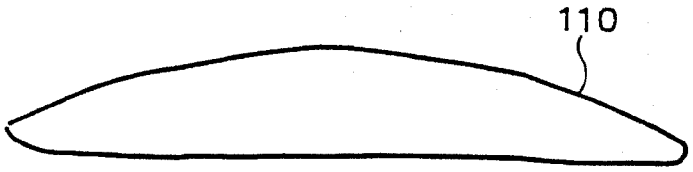
FIGS. 12A, 12B, and 12C are pictorial representations of side view Scanning Electron Microscope ("SEM") photographs showing ink drops flattened according to this invention.

Drum 14 was cleaned and intermediate transfer surface 12 was renewed. Drum 14 was heated to a 30° C. temperature and imaged with patterns of individual ink drops that were washed off and inspected by a SEM. FIG. 12A is a pictorial representation of a side view SEM photograph showing that a representative ink drop 110 of the flattened ink drops has a diameter to height ratio of 6:1.

Figure 12B:
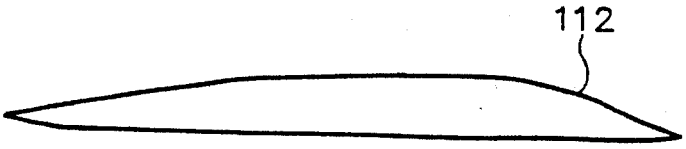

Subsequent experiments were conducted to determine the effect of drum temperature and transfer surface application pressure on ink drop flattening. Drum 14 was heated to 30° C., intermediate transfer surface 12 was applied at a 17.5 psi application pressure, and drum 14 was imaged with patterns of individual ink drops that were washed off and inspected by the SEM. FIG. 12B is a pictorial representation of a side view SEM photograph showing that a representative ink drop 112 of the flattened ink drops has a diameter to height ratio of 10:1.

Figure 12C:
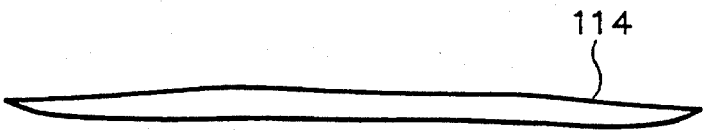

Drum 14 was heated to about 50° C., intermediate transfer surface 12 was applied twice at about a 25 psi application pressure, and drum 14 was imaged with patterns of individual ink drops that were washed off and inspected by the SEM. FIG. 12C is a pictorial representation of a side view SEM photograph showing that a representative ink drop 114 of the flattened ink drops has a diameter to height ratio of 16:1.

The above-described experimental results indicate that a phase-change ink-jet printer ejecting ink drops onto a liquid intermediate transfer surface results in an ink image in which the individual drops have a diameter to height ratio in a range of about 6:1 to about 16:1. The ink drop diameter to height ratio can be controlled by selecting the type and thickness of the liquid applied as the intermediate transfer surface, the drum temperature, and the jetted drop temperature, volume, and ejection velocity. The use of more viscous liquids, such as silicone oil, in very thin layers, such as about 100 nanometers will vary the diameter to height ratio from about 1.5:1 to greater than about 4:1, more typically being about 2:1. The silicone oil thickness can vary from about 0.05 microns to about 5.0 microns. Ink drop thickness should be made as thin as possible while maintaining the required color saturation in the image. Because the ink drops solidify on the intermediate transfer surface with approximately the final thickness and diameter, any transfer, post processing, or fusing processes need only be optimized to provide predetermined degrees of process window parameters.

For transfer printing applications, heat and pressure in nip 22 provide some additional flattening and spreading of ink image 26 on final receiving substrate 21. However, the majority of ink drop flattening is accomplished on drum 14, virtually eliminating any need for ink image post processing or fusing. Moreover, this invention also allows ink drops deposited adjacent to secondary solid color filled areas to spread out and touch the filled areas, which is not generally possible with conventional roller fusers because of the longitudinal stiffness of such rollers. Rather, the ink drops flatten and spread radially outward with minimal internal stress because the ink is still in its liquid phase. It is believed that ink drops formed in such a manner are more durable than those subjected to conventional fusing pressures.

Skilled workers will recognize that portions of this invention may have alternative embodiments. For example this invention may be employed in direct phase-change ink-jet printing to enhance drop flattening and spreading of ink drops ejected directly onto a final print medium, such as a transparency film. In this embodiment of the invention, the transparency film is first coated with an ink image receiving liquid layer. The liquid layer then receives the molten phase-change ink image. The individual ink drops spread and flatten upon contact with the liquid layer in a manner like that described above for transfer printing. The liquid layer evaporates leaving the flattened and spread ink drops on the transparency film in a geometric orientation suitable for rectilinear light transmission. The liquid layer may be an evaporative liquid, an adhesion-promoting liquid, or a curable adhesive liquid. Possible curing processes may entail evaporation, heating, exposure to ultraviolet energy, chemical reaction, or some combination thereof.

Figure 13:
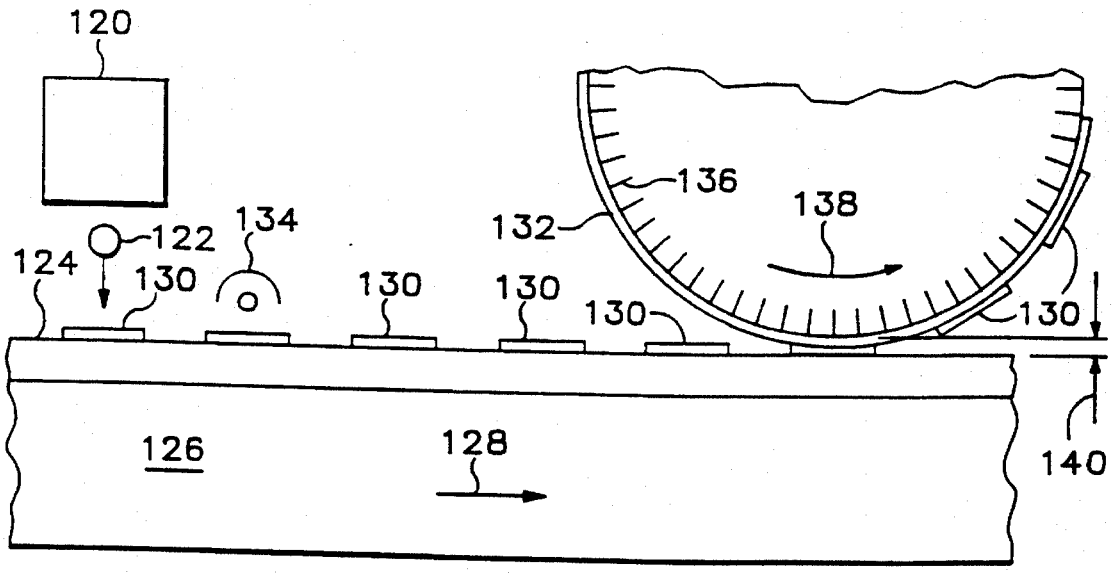
FIG. 13 is a schematic pictorial elevation view showing a phase-change ink-jet transfer printing process employing electrostatic attraction according to an alternate embodiment of this invention.

FIG. 13 shows another embodiment of this invention in which an ink-jet printhead ejects drops 122 of phase-change ink onto a relatively thick liquid layer 124, such as a viscous puddle of dielectric fluid, that is supported on a support surface 126 that moves in a direction indicated by an arrow 128. When drops 122 contact liquid layer 124 they flatten, spread, and cool as described above to form an ink image 130. Because liquid layer 124 is relatively fragile, transferring ink image 130 to a final receiving medium 132 entails a process, such as electrostatic attraction.

Drops 122 forming ink image 130 are charged to a first voltage polarity by a charging corona 134 as they move in direction 128. Final receiving medium 132 is supported by a media support 136, such as a drum, that moves in a direction indicated by an arrow 138 and which is at a voltage polarity opposite to that of ink image 130. A spacing 140 between liquid layer 124 and final receiving medium 132 is sufficiently small such that ink image 130 is attracted by and attached to final receiving medium 132. Adequate adhesion of ink image 130 to final receiving medium 132 may require optional post processing or fusing.

Charging corona 132 can be eliminated if drops 122 are jetted from printhead 120 in a charged state. Alternatively, support surface 126 may be a dielectric material and fluid layer 124 could be charged such that ink image 130 is transferred to final receiving medium 132.

Also, the drum heater 28 may be eliminated if a process window can be obtained that includes a drum temperature of about 30° C. Monochrome or color printing embodiments of the invention are possible. Other than a drum type supporting surface may be used, such as a flat platen or a belt. This invention may be embodied in various media marking applications, such as facsimile machines, copiers, and computer printers. The process window also may differ depending on various combinations of nip pressure, ink composition, intermediate transfer surface composition, drum surface finish and composition, and print medium composition. The intermediate transfer surface also may be applied to the drum in various ways, such as by an oil saturated web and metering blade assembly, a wick and reservoir with a dry cleaning web followed by a metering blade, buffing with an oil-soaked material, or use of an oil-soaked pad. Also, roller 23 could be heated to facilitate transfer and fusing of the image 26 to the final receiving substrate 21. Similarly, the printed medium preheater 27 could be eliminated to facilitate duplex printing applications or to employ different printing process windows.

It will be obvious to those having skill in the art that many changes may be made to the details of the above-described embodiments of this invention without departing from the underlying principles thereof. Accordingly, it will be appreciated that this invention is also applicable to phase change ink-jet imaging applications other than those found in printers. The scope of the present invention should, therefore, be determined only by the following claims.

We claim:

1. An imaging apparatus, comprising:

an applicator applying a liquid intermediate surface to a supporting surface, the liquid intermediate surface including at least one of an evaporative liquid, an adhesion promoting liquid, and a curable adhesive liquid;

an ink-jet printhead ejecting liquid phase-change ink drops toward the liquid intermediate surface; the ink drops flattening, spreading, and cooling following contact with the liquid intermediate surface to form a solid phase change ink image in which the cooled ink drops have a diameter to height ratio from about 1.5:1 to greater than about 4:1; and a transparency film final receiving medium that receives the ink image from the liquid intermediate surface whereby the ink image adheres to the transparency film in a configuration suitable for substantially rectilinear light transmission.

2. The apparatus of claim 1 in which the diameter to height ratio of the cooled ink drops is in a range from about 6:1 to about 16:1.

3. The apparatus of claim 1 further including an electrostatic charge means for causing the ink image to be at a different electrostatic potential than the final receiving medium such that electrostatic attraction effects transfer of the ink image from the intermediate surface to the final receiving medium.

4. The apparatus of claim 3 in which the intermediate surface is a dielectric fluid and the electrostatic charge means is a charging corona directed toward the ink image.

5. The apparatus of claim 1 further including a rotating drum and a roller forming a nip therebetween, and in which the supporting surface is on the drum and the transparency film final receiving medium is fed into the nip to receive the ink image from the liquid intermediate surface.

6. The apparatus of claim 5 in which the drum is heated by a drum heater to a temperature in a range from about 30° C. to about 55° C.

7. The apparatus according to claim 1 wherein the liquid intermediate surface is silicone oil and the diameter to height ratio of the cooled ink drops is greater than about 1.5:1.

8. An imaging method, comprising:

placing a liquid intermediate surface on a supporting surface;

ejecting liquid phase-change ink drops toward the liquid intermediate surface;

providing a transparency film final receiving medium;

transferring the solid ink image from the liquid intermediate surface to the transparency film final receiving medium;

forming a solid phase change ink image as the ink drops flatten, spread, and cool following contact with the liquid intermediate surface such that the solid ink drops have a diameter to height ratio from about 1.5:1 to greater than about 4:1; and transmitting light through the transparency film final receiving medium and the solid ink image in a substantially rectilinear manner suitable for projection.

9. The method of claim 8 in which the diameter to height ratio of the solid ink drops is in a range from about 6:1 to about 16:1.

10. The method according to claim 8 in which using silicone oil as the intermediate surface and the diameter to height ratio of the cooled ink drops is greater than about 1.5:1.

11. The method of claim 8 in which the providing and transferring steps further comprise:

forming a nip between a rotating drum and a roller, the supporting surface being on the drum;

feeding the final receiving medium into the nip; and transferring the ink image from the intermediate surface on the drum to the final receiving medium.

12. The method of claim 11 further including the step of heating the drum to a temperature in a range between about 30° C. to about 55° C.

13. The method of claim 11 in which the transferring step further comprises:

charging the ink image to an electrical potential different from that of the final receiving medium;

placing the ink image proximate to the transparency film final receiving medium; and attracting the solid ink image from the liquid intermediate surface to the transparency film final receiving medium by electrostatic attraction.

14. The method of claim 13 in which the charging step comprises directing a charging corona toward the ink image.

* * * * *